US009226366B2

(12) United States Patent
Orillard et al.

(10) Patent No.: US 9,226,366 B2
(45) Date of Patent: Dec. 29, 2015

(54) CONTROL SYSTEM FOR ACTIVE WINDOW GLASS MANAGING THE COLOUR OF THE LIGHT IN A BUILDING

(75) Inventors: Julien Orillard, Paris (FR); David Nicolas, Paris (FR)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 271 days.

(21) Appl. No.: 13/995,039

(22) PCT Filed: Dec. 14, 2011

(86) PCT No.: PCT/FR2011/052978

§ 371 (c)(1),
(2), (4) Date: Jun. 17, 2013

(87) PCT Pub. No.: WO2012/080656

PCT Pub. Date: Jun. 21, 2012

(65) Prior Publication Data

US 2013/0264948 A1 Oct. 10, 2013

(30) Foreign Application Priority Data

Dec. 16, 2010 (FR) ..... 10 60626

(51) Int. Cl.
*H05B 37/02* (2006.01)
*H05B 33/08* (2006.01)

(52) U.S. Cl.
CPC ..... *H05B 37/02* (2013.01); *H05B 33/0869* (2013.10)

(58) Field of Classification Search
CPC ..... G02F 1/1523; G02F 1/533; G02F 1/525
USPC ..... 315/155; 356/213; 362/276, 552, 554, 362/559, 147; 359/265, 245, 267, 275, 249
See application file for complete search history.

(56) References Cited

U.S. PATENT DOCUMENTS 7,535,614 B1 * 5/2009 Tapley et al. ..... 359/265
2005/0200295 A1 9/2005 Lim et al.

(Continued)

FOREIGN PATENT DOCUMENTS

CN 101147425 A 3/2008
CN 101210665 A 7/2008

(Continued)

OTHER PUBLICATIONS

Aldrich M., et al. "Energy efficient control of Polychromatic solid state lighting using a senor network", Proceeding of SPIE, vol. 7784, pp. 1-15, Aug. 2, 2010, XP009149388.

(Continued)

*Primary Examiner* — Lincoln Donovan
*Assistant Examiner* — Thomas Skibinski
(74) *Attorney, Agent, or Firm* — Oblon, McClelland, Maier & Neustadt, L.L.P.

(57) ABSTRACT

The present invention relates to a lighting control system, comprising a control unit comprising a memory in which control programs are recorded. The control programs are capable of controlling the optical transmission through an active window pane with electro-controllable optical transmission properties and are capable of controlling an electro-controllable lighting device. The system furthermore comprises a coloration sensor for measuring a value representative of a coloration of the light. The control programs are capable of controlling the lighting generated by the lighting device as a function of the value supplied by the coloration sensor.

15 Claims, 1 Drawing Sheet

(56) References Cited

U.S. PATENT DOCUMENTS

| | | | | |
|---|---|---|---|---|
| 2008/0157698 | A1 | 7/2008 | Tan et al. | |
| 2008/0184636 | A1 * | 8/2008 | Fisher | 52/204.5 |
| 2009/0284187 | A1 | 11/2009 | Diederiks et al. | |
| 2010/0296081 | A1 | 11/2010 | Granqvist | |

FOREIGN PATENT DOCUMENTS

| | | | |
|---|---|---|---|
| JP | 4-107534 | | 4/1992 |
| JP | 2010-9874 | | 1/2010 |
| WO | WO 2006/100650 | A2 | 9/2006 |
| WO | 2008 048181 | | 4/2008 |
| WO | 2010/079388 | A1 | 7/2010 |

OTHER PUBLICATIONS

"Lighting control systms", Aalto University School of Electrical Engineering, vol. 6 Lighting control, pp. 149-151, Retrived from the Internet: URL http://www. lightinglab.fi/IEAAnnex45/guidebook/, Oct. 5, 2010, XP002641998.

International Search Report Issued May 2, 2012 in PCT/FR11/52978 Filed Dec. 14, 2011.

* cited by examiner

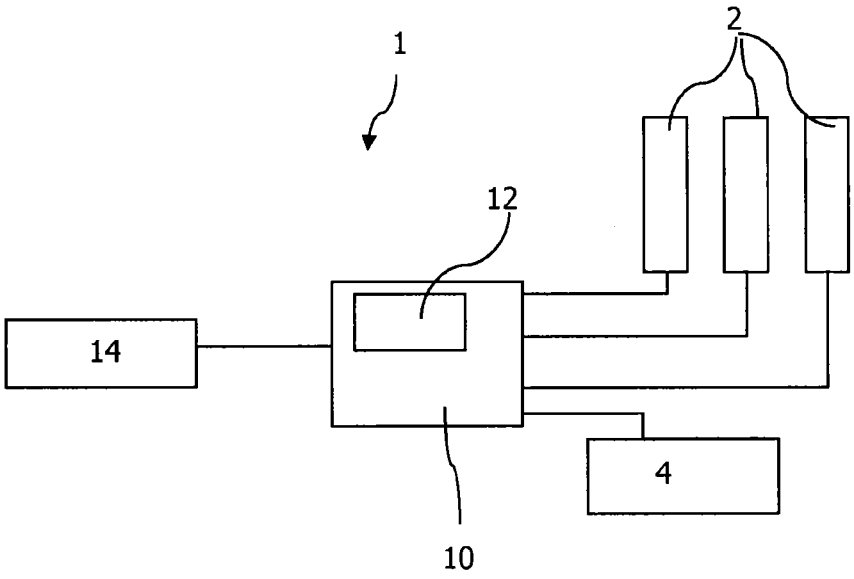
1
2
12
14
4
10

CONTROL SYSTEM FOR ACTIVE WINDOW GLASS MANAGING THE COLOUR OF THE LIGHT IN A BUILDING

FIELD OF THE INVENTION

The present invention relates to the field of the control of the light intensity in buildings.

BACKGROUND OF THE INVENTION

The windows of buildings have the drawback of contributing to the heating of the buildings in summer and to their cooling in winter.

Since the mid-1990s, a large variety of insulating and solar control windows have been developed by the glass industry. Thanks to "low emissivity" or "reflecting" coatings currently on the market, high levels of thermal insulation and of solar protection can be obtained.

Nevertheless, these windows have fixed properties which cannot be adapted to the temperature and sunshine conditions.

Window glass with variable optical properties provides a solution to this problem.

These active glass panes, referred to as "intelligent glass", have optical transmission properties that are modifiable, for example electrically.

One known solution is to use electrochromic window glass to minimize the energy consumption of the building.

US-A-2007/0067048 describes a system for controlling electrochromic windows aiming to minimize the energy consumption of the building while at the same time providing a certain brightness inside of the building.

Nevertheless, electrochromic glass modifies the spectral distribution of the transmitted light, which can be a drawback, even if a user does not necessarily realize it.

Indeed, it will be a drawback for example in a museum if the colors of the works exhibited are modified, even in an unnoticeable manner for the visitor.

Furthermore, an environment even very slightly colored can produce certain psychological effects on the nervous system. Colors with a long wavelength (red) have a stimulating effect whereas colors with a short wavelength (violet) have a calming effect. The intermediate colors (yellow, green), have a tonic effect favorable to concentration.

SUMMARY OF THE INVENTION

One aim of the present invention is to provide an active system with electro-controllable optical transmission properties for equipping a room of a building allowing the drawbacks of a spectral distribution shift of the light in the room to be avoided even if this shift is not noticeable for the user.

According to one aspect of the invention, the lighting control system comprises:

- a control unit comprising a memory in which control programs are recorded, the control programs being capable of controlling the optical transmission through an active window pane with electro-controllable optical transmission properties, the control programs being capable of controlling an electro-controllable lighting device; and
- a coloration sensor for measuring a value representative of a coloration of the light and supplying this value to the control unit, the control programs being capable of controlling the lighting generated by the lighting device as a function of the value supplied by the coloration sensor.

According to particular embodiments, the cell comprises one or more of the following features, taken in isolation or according to all the technically possible combinations:

- the control programs are capable of controlling the lighting device so that it generates an illumination whose coloration is such that the lighting generated by the lighting device comes close to the coloration of the light measured by the sensor measuring coloration of a reference value;
- the control programs are capable of controlling the lighting device in order to generate different colored lighting effects depending on the value supplied by the coloration sensor;
- the lighting device comprises an artificial source of light;
- the lighting device comprises at least one color LED, preferably several different color LEDs, the control programs being capable of controlling the intensity of the lighting of the at least one color LED as a function of the value supplied by the coloration sensor;
- the lighting device comprises a reflector reflecting the outside light toward the inside in an electro-controllable manner, for example an electro-controllable and reflecting venetian blind;
- the control programs are capable of controlling the optical transmission through the active window pane as a function of the value supplied by the coloration sensor;
- the control programs are capable of controlling several active window panes with electro-controllable optical transmission properties, the control programs being capable of controlling said active window panes in such a manner that one of said active window panes receives an optical transmission setpoint value different from that of another of said active window panes;
- the coloration sensor supplies a CRI value or a value representative of at least a* or b* of the (L*,a*,b*) coloration system or a value representative of at least X, Y or Z of the (X,Y,Z) system or a value representative of at least u* or v* of the (L*,u*,v*) system;
- the system comprises a brightness sensor for supplying a value representative of brightness, the control programs being capable of controlling the optical transmission through the active window pane as a function of the value representative of brightness supplied by the brightness sensor;
- the system comprises a temperature sensor for supplying a value representative of temperature, the control programs being capable of controlling the optical transmission through said active window pane as a function of the value representative of temperature supplied by the temperature sensor;
- the system comprises a glare level sensor for supplying a value representative of glare level, the control programs being capable of controlling the optical transmission through said active window pane as a function of the value representative of glare level supplied by the glare level sensor.

Another subject of the invention is an assembly comprising an active window pane with electro-controllable optical transmission properties, a lighting device and a control system for controlling the active window pane and the lighting device, the control system being such as described hereinabove.

A further subject of the invention is a method for controlling an active window pane with electro-controllable optical transmission properties and a lighting device comprising steps consisting in:

using a coloration sensor for measuring a value representative of coloration of a light;

controlling the lighting generated by the lighting device as a function of the value supplied by the coloration sensor.

According to particular embodiments, the method comprises one or more of the following features, taken in isolation or according to all the technically possible combinations:

- the step consisting in controlling the lighting generated consists in controlling the lighting device so that it generates an illumination whose spectral distribution is such that the lighting generated by the lighting device neutralizes, at least partially, the shift of the spectral distribution of the light transmitted through the at least one active window pane;
- the lighting generated has a coloration adapted so that the lighting device comes close to the coloration of the light measured by the sensor measuring coloration of a reference value;
- the lighting is controlled in order to generate different colored lighting effects depending on the value supplied by the coloration sensor;
- the lighting device comprises an artificial source of light;
- the lighting device comprises at least one color LED, preferably several different color LEDs, the intensity of the lighting of the at least one color LED being controlled as a function of the value supplied by the coloration sensor;
- the lighting device comprises a reflector reflecting the outside light toward the inside in an electro-controllable manner, for example an electro-controllable and reflecting venetian blind;
- the optical transmission through the active window pane is controlled as a function of the value supplied by the coloration sensor;
- several active window panes with electro-controllable optical transmission properties are controlled in such a manner that one of said active window panes receives an optical transmission setpoint value different from that of another of said active window panes;
- the coloration sensor supplies a CRI value or a value representative of at least a* or b* of the (L*,a*,b*) coloration system or a value representative of at least X, Y or Z of the (X,Y,Z) system or a value representative of at least u* or v* of the (L*,u*,v*) system;
- the system comprises a brightness sensor for supplying a value representative of brightness, the optical transmission through the active window pane being controlled as a function of the value representative of brightness supplied by the brightness sensor;
- the system comprises a temperature sensor for supplying a value representative of temperature, the optical transmission through said active window pane being controlled as a function of the value representative of temperature supplied by the temperature sensor;
- the system comprises a glare level sensor for supplying a value representative of glare level, the optical transmission through said active window pane being controlled as a function of the value representative of glare level supplied by the glare level sensor.

BRIEF DESCRIPTION OF THE DRAWINGS

The invention will be better understood upon reading the description that follows, presented solely by way of example, and with reference to the appended drawing.

FIG. 1 is a diagram of a device according to the invention.

DETAILED DESCRIPTION OF THE INVENTION

The device is a system 1 for controlling the lighting of a room of a building.

The room is equipped with several active window panes 2 with electro-controllable optical transmission properties, more particularly with electrochromic glass panes, and with an electro-controllable lighting device 4.

The system for controlling the lighting 1 controls the active window panes 2 and the lighting device 4.

The system 1 described relates to a single room but, more generally, the control system 1 can control the lighting of several rooms of a building.

Electrochromic windows 2 are glass panes including an electrochemically active device chemically reacting to the application of an electrical power supply. The optical transmission of an electrochromic window 2 is thus electrically controlled.

The optical domain is understood to mean the visible, infrared and ultraviolet domains.

Many electrochromic glasses 2 exist.

They are generally classified into three categories: "all organic" or "all polymer", "mixed", in other words both organic and inorganic, and "all solid", in other words generally all inorganic.

U.S. Pat. No. 5,239,406 and EP-A-0 612 826 describe for example electrochromic organic devices.

EP-0 253 713 and EP-0 670 346, EP-0 382 623, EP-0 518 754 or EP-0 532 408 describe electrochromic mixed devices.

EP-0 831 360 and WO-A-00/03290 describe all solid electrochromic devices.

Advantageously, the electrochromic device is a device referred to as "all solid". Such a device has the advantage of being durable, since it is composed of inorganic layers. Such a device furthermore has the advantage of allowing the number of substrates to be minimized, the layers being deposited onto a single substrate.

Nevertheless, the glass panes 2 are not necessarily electrochromic; they are in general active window panes with electro-controllable optical transmission properties, for example made of gasochromic or thermochromic glass.

The control system comprises a control unit 10 equipped with a memory 12 in which programs are recorded for controlling active window panes 2, in other words the optical transmission through the active window panes 2.

It should be noted that the control of active window panes 2 is conventionally carried out by sending a setpoint voltage to the terminals of the glass panes 2, different values of voltage controlling different states of optical transmission through the glass panes 2.

The control system 1 furthermore comprises a coloration sensor 14 for the light in the room and the programs are designed to control the active window panes 2 depending on the coloration value supplied by the coloration sensor 14.

The coloration sensor 14 is advantageously placed in an area of the room where it is desired to control the coloration, for example in a work place such as an office.

The coloration sensor 14 is for example a sensor supplying a CRI value (Colour Rendering Index) for example the Ra or R96a value from the CIE (International Commission on Illumination).

As a variant, the sensor supplies a coloration value of any suitable type, for example a value in a coloration system defined by the CIE, for example a value of L*, a* and b* in the (L*, a*, b*) coloration system of the CIE or a value of X, Y and Z in the XYZ system of the CIE or a value of L*, u* and v* in the (L*,u*,v*) system of the CIE.

It should be noted that the (L*, a*, b*) system, which is widely used, characterizes a color by means of an intensity parameter L* corresponding to the luminance and of two chrominance parameters (a*, b*) which describe the color.

This system has been specially designed so that the calculated distances between colors correspond to the differences perceived by the human eye. For example, the combination L* is the clarity, which goes from 0 (black) to 100 (white), the component a* represents the range of the red axis (positive value)→green (negative) going through white (0) if the clarity is equal to 100 and the component b* represents the range of the yellow axis (positive value)→blue (negative) going through white (0) if the clarity is equal to 100.

Generally speaking, the coloration sensor 14 is capable of supplying a value representative of a color or "chrominance" of the light received by the sensor, in other words of giving a relative chromatic indication to this light.

It should be noted that the term "value" is to be understood throughout the text in its wider sense. It can be a value of any suitable type. It can for example be a single numerical value, or of a set of values such as a vector or a matrix.

The term "representative" is understood to mean that this value allows information of any suitable type to be obtained on the coloration of the light being analyzed.

The control programs are capable of controlling the lighting device 4 so that it generates an illumination whose coloration is such that the lighting generated by the lighting device 4 comes close to the coloration of the light measured by the sensor 14 measuring the coloration of a reference value which is for example predetermined or calculated.

If the light transmitted by the active window panes 2 is shifted toward the blue, the light from the lighting device 4 will for example be shifted toward the red with respect to the light transmitted by the active window panes 2.

The lighting device 4 for example comprises LEDs, for example several color LEDs, in order for example to control the color of the illumination by the intensity of each color LED.

Generally speaking, this is a lighting device 4 whose coloration rebalances the coloration of the light analyzed by the coloration sensor toward a desired lighting coloration.

Advantageously, the coloration of the illumination generated by the lighting device 4 is adjustable, since it is an artificial illumination.

As a variant, however, but non-exclusively, the system 1 comprises an electro-controllable lighting device 4 supplying a natural light. This is for example a device reflecting the outside light with an adjustable angle, for example an electro-controllable venetian blind, and capable of reflecting the outside light toward the inside. The device 4 is advantageously configured and arranged for reflecting the outside light toward the ceiling of the room. This device 4 is for example positioned in front of a clear glass pane or tinted with a color chosen to come close to the light in the room of a particular color, for example of white color.

According to a first embodiment, the system 1 controls the active window panes 2 independently of the value supplied by the coloration sensor 14. The effects of the coloration are corrected but not their cause.

According to a second embodiment, the system 1 controls the active window panes depending on the coloration value supplied by the coloration sensor 14. The system thus acts on the cause if the variation of color is judged to be unacceptable, for example in view of other criteria such as the brightness in the room.

The control system 1 furthermore comprises for example a brightness sensor for supplying a value representative of brightness in the room, and/or a temperature sensor for supplying a value representative of temperature in the room, and/or a glare level sensor for supplying a value representative of glare level in the room.

The control programs are then capable of controlling the optical transmission through the active window panes as a function of the values representative of coloration, of brightness and/or of temperature and/or of glare level. It should be noted that the sensors are of any suitable type. Furthermore, a sensor for the presence of a person in the room may also be used.

The glare level sensor is for example a digital camera associated with a processing unit capable of supplying a value of glare level, for example in DGI.

As a reminder, the DGI glare level value is defined as $$DGI=10 \text{ Log } 10.478\Sigma[(Lw^{1.6}*\Omega^{0.6})/(Lb+0.07*\omega*0.5Lw)], \text{ with}$$

Lw=Luminance of the window (nits)

Lb=Luminance of the background (nits)

Ω=Solid angle of the window modified by the position of the source (sr)

Ω=Solid angle of the source seen from the point of observation (sr) As a variant, the evaluation of the importance of the glare level can be carried out by using various values. These values have been developed in order to characterize the physical sensation of dazzling. These various values could be used independently or as a complement to one another:

the "Glare index" GI or BRI or BGI which is described in the article by P. Petherbridge, R. G. Hopkinson, Discomfort Glare and the Lighting of Buildings, transactions of the Illuminating Engineering society 15 (39) (1950), London, UK.

the "Discomfort Glare Rating" (DGR) associated with the "Daylight Glare Index" (DGI) described by R. G. Hopkinson, Glare from daylighting in buildings, Applied Ergonomics 3 (4) (1972).

the "Visual Comfort Probability" (VCP) described in DiLaura, David L., On the Computation of Visual Comfort Probability, Journal of the Illuminating Engineering Society, Vol. 5, July 1976, Pg. 207 the CGI and the "Unified Glare Rating System" (UGR) described by the CIE in Discomfort Glare in the Interior Lighting, Commission Internationale de l'Eclairage (CIE), Technical committee TC-3.13, Division 4, Interior Environment and Lighting design, Vienna Austria, 1992.

Generally speaking, a value of any suitable type can be used.

The brightness sensor is for example placed inside of the room. Nevertheless, as a variant, the sensor is placed outside of the building.

The temperature sensor is, for its part, preferably placed inside of the room.

The presence sensor is, as a variant, replaced by a clock, the presence in a room corresponding to a predetermined timetable.

The glare level sensor can be a brightness sensor, preferably outside of the building, associated with a clock. Indeed, the clock allows the position of the sun in the sky to be determined and thus the value of glare level as a function of the measured value of brightness.

Furthermore, the system can comprise one or more sensors of each type. The function of several sensors can also be carried out by a single device. A CCD camera can for example provide the function both of glare level sensor and of brightness sensor.

Throughout the text, the terms "a sensor A and a sensor B" should not be understood as implying necessarily two separate devices; this may be one and the same device supplying two measurements. The same applies to the term "unit".

Lastly, the room may furthermore be equipped with screening means such as blinds, curtains, PDLCD windows, etc., the control system 1 also being capable of controlling the screening means.

As a variant, the control system only comprises one or a combination of more than one sensor from amongst the sensors hereinabove.

It should be noted that, throughout the text, the term "as a function of" should be understood in an inclusive manner and not in an exclusive manner. By way of example, the term "as a function of a coloration value" does not exclude a value of brightness, of temperature and of glare level also being taken into account.

The glare level sensor is for example a digital camera associated with a processing unit capable of supplying a glare level value, for example in DGI.

As a reminder, the DGI glare level value is defined as:

$$DGI=10 \text{ Log } 10.478\Sigma[(Lw^{1.6}*\Omega^{0.6})/(Lb+0.07*\omega*0.5Lw)] \text{ with:}$$

Lw=Luminance of the window (nits)

Lb=Luminance of the background (nits)

Ω=Solid angle of the window modified by the position of the source (sr)

Ω=Solid angle of the source seen from the point of observation (sr)

Another subject of the invention is a room of a building equipped with at least one active window pane with electro-controllable optical transmission properties, a lighting device and a control system for controlling the active window pane and the lighting device, the control system being as claimed in any one of the preceding claims.

The invention claimed is:

1. A lighting control system, comprising:

a control unit having a memory in which control programs are recorded, the control programs programmed to separately control each of optical transmission through an active glass pane with electro-controllable optical transmission properties, and an electro-controllable lighting device; and a coloration sensor for measuring a value representative of a coloration of light and supplying the value to the control unit, the control programs programmed to control lighting generated by the lighting device as a function of the value supplied by the coloration sensor.

2. The system as claimed in claim 1, in which the control programs are programmed to control the lighting device to generate an illumination whose coloration is such that lighting generated by the lighting device makes the coloration of the light measured by the sensor measuring coloration closer to a reference value.

3. The system as claimed in claim 1, in which the control programs are programmed to control the lighting device to generate different colored lighting effects depending on the value supplied by the coloration sensor.

4. The system as claimed in claim 1, in which the lighting device comprises an artificial source of light.

5. The system as claimed in claim 4, in which the lighting device comprises at least one color LED, or plural different color LEDs, the control programs programmed to control intensity of the lighting of the at least one color LED as a function of the value supplied by the coloration sensor.

6. The system as claimed in claim 1, in which the lighting device comprises a reflector reflecting outside light toward an inside in an electro-controllable manner, or comprises an electro-controllable and reflecting venetian blind.

7. The system as claimed in claim 1, in which the control programs are programmed to control the optical transmission through the active glass pane as a function of the value supplied by the coloration sensor.

8. The system as claimed in claim 1, in which the control programs are programmed to control plural active glass panes with electro-controllable optical transmission properties, the control programs programmed to control the active glass panes such that one of the active glass panes receives an optical transmission setpoint value different from that of another of the active glass panes.

9. The system as claimed in claim 1, in which the coloration sensor supplies a CRI value or a value representative of at least a* or b* of the (L*,a*,b*) coloration system or a value representative of at least X, Y or Z of the (X,Y,Z) system or a value representative of at least u* or v* of the (L*,u*,v*) system.

10. The system as claimed in claim 1, further comprising a brightness sensor for supplying a value representative of brightness, the control programs programmed to control the optical transmission through the active glass pane as a function of the value representative of brightness supplied by the brightness sensor.

11. The system as claimed in claim 1, further comprising a temperature sensor for supplying a value representative of temperature, the control programs programmed to control the optical transmission through the active glass pane as a function of the value representative of temperature supplied by the temperature sensor.

12. The system as claimed in claim 1, further comprising a glare level sensor for supplying a value representative of glare level, the control programs programmed to control the optical transmission through the active glass pane as a function of the value representative of glare level supplied by the glare level sensor.

13. An assembly comprising:

an active glass pane with electro-controllable optical transmission properties;

a lighting device; and a control system for controlling the active glass pane and the lighting device, the control system being as claimed in claim 1.

14. A method for separately controlling each of an active glass pane with electro-controllable optical transmission properties, and a lighting device, the method comprising:

using a coloration sensor for measuring a value representative of coloration of a light;

supplying the value representative of coloration of the light to a control unit; and controlling the lighting generated by the lighting device as a function of the value supplied by the coloration sensor.

15. The method as claimed in claim 14, the controlling the lighting generated includes controlling the lighting device to generate an illumination whose spectral distribution is such that the lighting generated by the lighting device neutralizes, at least partially, a shift of spectral distribution of light transmitted through the at least one active glass pane.

* * * * *